US012595217B2

(12) United States Patent
Scevola

(10) Patent No.: US 12,595,217 B2
(45) Date of Patent: Apr. 7, 2026

(54) THERMITE BLOCK FOR STORED-DATA DESTRUCTION

(71) Applicant: Carlo Scevola, Santo Domigo (DO)

(72) Inventor: Carlo Scevola, Santo Domigo (DO)

( * ) Notice: Subject to any disclaimer, the term of this patent is extended or adjusted under 35 U.S.C. 154(b) by 352 days.

(21) Appl. No.: 18/367,926

(22) Filed: Sep. 13, 2023

(65) Prior Publication Data

US 2025/0084011 A1 Mar. 13, 2025

(51) Int. Cl.

| | |
|---|---|
| ***C06B 33/14*** | (2006.01) |
| ***C06B 21/00*** | (2006.01) |
| ***C06B 31/02*** | (2006.01) |
| ***C06B 33/02*** | (2006.01) |

(52) U.S. Cl.
CPC ..... *C06B 33/14* (2013.01); *C06B 21/0033* (2013.01); *C06B 31/02* (2013.01); *C06B 33/02* (2013.01)

(58) Field of Classification Search
None
See application file for complete search history.

(56) References Cited

U.S. PATENT DOCUMENTS

| | | | | |
|---|---|---|---|---|
| 1,082,474 | A | 12/1913 | Colman | |
| 1,148,002 | A | 7/1915 | Anderson | |
| 6,627,013 | B2 * | 9/2003 | Carter, Jr. | C06B 33/00 149/40 |
| 6,928,551 | B1 | 8/2005 | Lee et al. | |
| 8,255,620 | B2 | 8/2012 | Frost et al. | |
| 8,461,863 | B2 | 6/2013 | Pedersen et al. | |
| 8,816,717 | B2 | 8/2014 | Fritz et al. | |
| 8,864,924 | B2 | 10/2014 | Coffey et al. | |
| 9,021,333 | B1 | 4/2015 | Northcott | |
| 9,471,512 | B2 | 10/2016 | Frost et al. | |
| 9,573,858 | B1 * | 2/2017 | Brothers | F42B 12/207 |
| 10,724,320 | B2 | 7/2020 | Huang et al. | |
| 2004/0205352 | A1 | 10/2004 | Ohyama | |
| 2009/0220088 | A1 | 9/2009 | Lu et al. | |

* cited by examiner

*Primary Examiner* — Aileen B Felton
(74) *Attorney, Agent, or Firm* — Robert Brownstein

(57) ABSTRACT

The invention is a multi-layer thermite block, encased in an exterior protective shield with one face exposed. The exposed face is carved out to accommodate a target device such that the block encompasses the target device when placed atop the device. When receiving a data-destruction signal, the block is ignited producing a short-duration blast of heat sufficient to severely damage or destroy all physical data-storing facilities of the target device.

14 Claims, 8 Drawing Sheets

Perspective

Top View

Bottom View

Side View

THERMITE BLOCK FOR STORED-DATA DESTRUCTION

TECHNICAL FIELD

The invention is a device comprising a thermite block used for permanent destruction of electronically stored data to preserve data security.

BACKGROUND OF INVENTION

Myriad electronic devices may have sensitive, stored data that can be used nefariously if a device is lost, misappropriated, or stolen. Typically, data is stored in non-volatile memory devices and rotating-disk-drive devices. Even where electronic countermeasures are present, so long as the stored data is present, there are means for capturing and decoding it.

The only sure way to prevent data from being exploited when a device falls into the wrong hands is to physically destroy the storage device and its data before it can be captured and decoded.

It turns out that non-volatile memory and disk-drive devices have operating heat ranges above which their functionality becomes unreliable. When the heat is much higher than an upper operating heat limit, the devices and their storage means can be physically destroyed.

Ideally, if using such a means for destroying stored data, one should limit the extent of destruction to the target storage devices to avoid unintended catastrophic consequences.

BRIEF DESCRIPTION OF THE INVENTION

The invention is a block of thermite materials that can be ignited by a relatively low-voltage destruction signal, which then produces an exothermic reaction of high heat and short duration.

The thermite block is dimensioned to encompass a target memory-storage device so as to concentrate the exothermic heat upon that device while limiting heat or material leakage external to the thermite block.

A target device effectively encompassed in the thermite block will, after being exposed to high heat for a short duration, be physically damaged along with any data stored in it.

Thermite is relatively safe to handle, and will not ignite at temperatures well above water's boiling point. Thus, a thermite block encompassing a target data-storage device is benign except in cases where it is ignited intentionally.

The invention's thermite block is encased on five sides by a protective shell which effectively contains the heat reaction within the shell allowing focusing of the heat on the target device. On the bottom face of the block, which is not contained by the shell, a carve-out space allows the target device to be encompassed within while sealing the bottom face periphery to an underlying surface. In that way, leakage of heat and material is mitigated while ensuring that the material is effectively shielded from water, if submerged.

Because the thermite reaction is self-contained and does not require external oxygen, the thermite block would ignite in a vacuum as well as under water if the shell provides effective waterproofing.

DETAILED DESCRIPTION OF INVENTION

Figure 1:
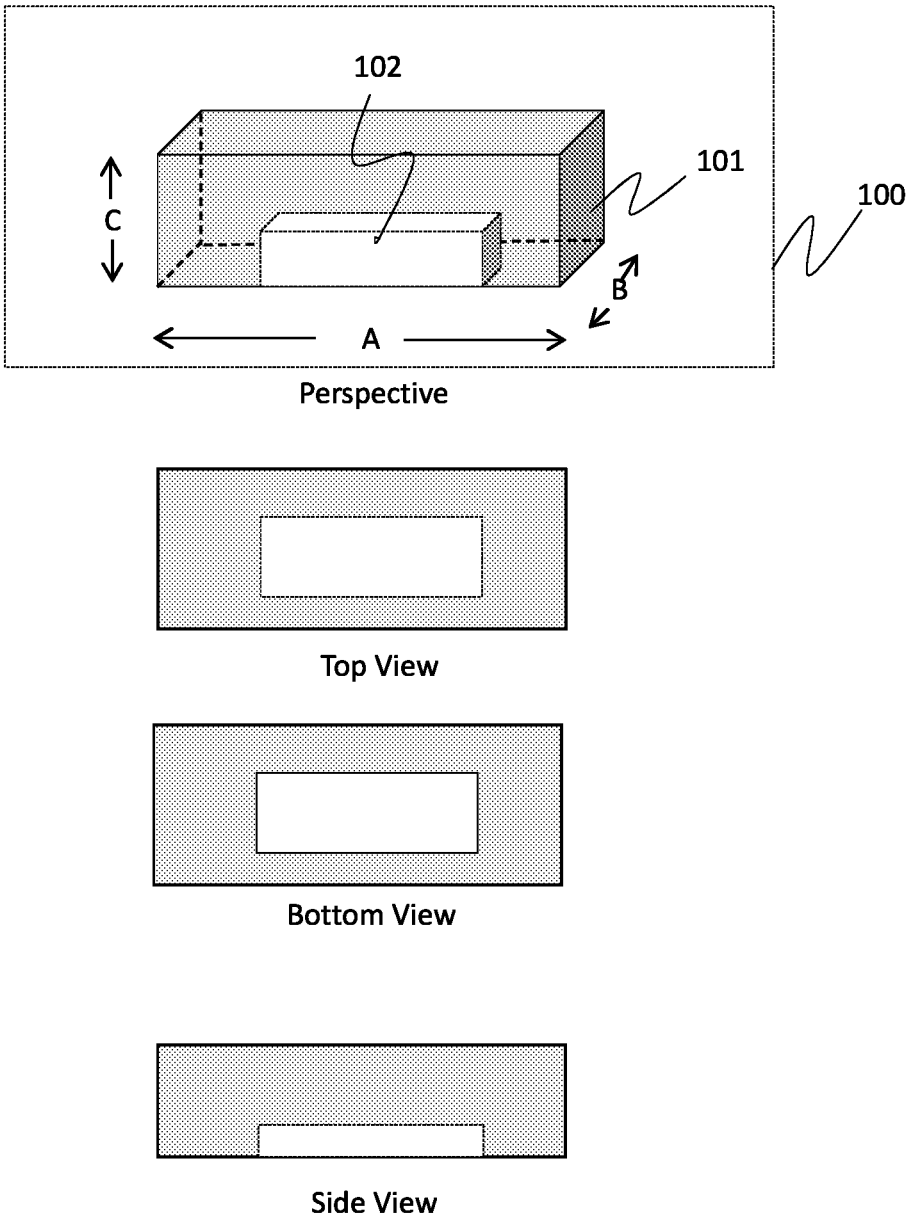
FIG. 1 depicts a three-dimensional view of the invention including top, bottom and side views.

Electronic devices often comprise data-storage devices that can store sensitive data which may be captured and decoded for nefarious purposes should a device be lost, misappropriated, or stolen. So long as the stored data is intact, even if electronic countermeasures are used to thwart access to the data, there are means for capturing and decoding that data. The only sure way to prevent such sensitive data from falling into the wrong hands is to make sure it is fully destroyed in circumstances of loss or theft.

In NAND flash-memory devices, data is stored non-volatilely as bits (0 or 1) in NAND-gate-based memory cells. While such devices have finite life times with regard to repeated write cycles, the stored data may be secure for many years, making it vulnerable to capture and decoding.

In rotating-disk-drive storage devices, data is stored as magnetically encoded bits in tracks on a disk. Again, unless physically damaged or destroyed, such data is vulnerable to capture and decoding.

Certain data erasure can only be achieved if the physical storage device is severely damaged or destroyed.

In both cases, semiconductor devices and disk-drive devices, the storage medium (e.g. memory cells or magnetic "bits" in tracks on a disk) can only be erased or destroyed if that medium is severely damaged or destroyed. A common denominator data destroyer is a short-duration burst of significant heat. When subjected to such, both non-volatile memory devices and disk drives will suffer severe damage or complete destruction. For purposes of lexicon, a non-volatile storage device to be the focus of data destruction will be referred to as a "target device," and includes any device—semiconductor or electromechanical—that serves as non-volatile data storage.

The word "thermite" covers a broad range of material combinations that can produce a rapid, exothermic reaction when ignited. For example, one definition of thermite is a combination of metal powder and metal oxide which when ignited by heat or a chemical reaction exhibits an exothermic reduction-oxidation reaction creating a short-duration burst of heat at high temperature confined to a small area. Constituent materials may comprise such metals as Aluminum, Magnesium, Titanium, Zinc. Silicon and Boron, which act as reducing agents; and oxidizers comprising oxides of Bismuth, Boron, Silicon, Chromium, Manganese, Iron, Copper and Lead.

It should be noted that heat or a chemical reaction can ignite a combination of thermite materials. Absent the heat or chemical reaction, the thermite material is stable, and safe from ignition. Thus, a block of thermite encompassing a target device simply acts as a benign enclosure unless ignited.

Most portable electronic devices, such as laptops, smartphones, tablets and the like are powered by batteries that are charged using external electrical power. These systems operate on voltages typically 3-5 volts. Therefore, assuming one wants to eliminate sensitive data stored on such a device, if a thermite block is used, it has to be able to be ignited by low voltage and current. In addition, a separate battery can be located near the thermite block that provides the voltage needed even in a case where the electronic device's battery is discharged. That triggering voltage could perhaps cause a mixing of chemicals to initiate a chemical reaction sufficient to ignite the thermite. Alternatively, the triggering voltage could be used to heat a conductor to sufficient temperature to ignite the thermite. In terms of reliability and speed, the latter approach was chosen, that is, heating a conductor.

The amount of heat required to ignite the thermite block may be determined by the materials used and the location of the heat source (e.g. the conductor). In general, using this method by itself to ignite a thermite block large enough to encompass a target device may take too long or require too much electrical energy.

A more reliable, faster, ignition approach is to use a separate layer of material—an ignition layer—operative to ignite quickly at a low-voltage trigger, and produce rapid ignition of the layer, which is in contact with a face of the thermite block. As a result, first the ignition layer ignites and quickly thereafter the thermite block ignites. That would be a faster, more reliable, means of igniting the thermite block. To reiterate, first one triggers an ignition layer, which in turn ignites the thermite block. For purposes of lexicon, this will be called a two-layer block (e.g. an ignition layer, and a thermite layer).

Tests have shown that a reliable, alternative, ignition means is to have a first ignition layer of a first combination of materials, placed atop a second ignition layer of a second combination of materials, placed atop the upper face of the thermite block. For purposes of lexicon, this will be called a three-layer block (e.g. a first ignition layer, a second ignition layer, and a thermite layer).

During tests it was found that different combinations of materials in ignition layers and a thermite layer would produce different results in terms of reliable ignition, speed and duration of exothermic reaction, and peak temperature. What are claimed are believed to be preferred embodiments of two-layer and three-layer thermite blocks. It was found that a range of proportions of layer constituents and block constituents could produce similar results. The ranges and materials claimed are a range within which reliability, ignition speed, exothermic speed, reaction duration, peak temperature and containment produced barely detectable differences in end results.

A block of thermite encompassing a target device, when ignited, may radiate heat in all directions, and may spray molten materials outward as well as downward. The objective, however, is to focus the heat and destructive forces downward so as to severely damage or destroy the target device. Therefore, a shell covering is used that encloses all but the bottom face of the two- or three-layered block, which is a face of the thermite layer. The shell may be made of very-high-melting-point metal (W, Re, Ta, Mo), ceramic, carbon fiber or graphite. Note that during pre-ignition operation of the protected system, the block and its shell will dissipate target device heat sufficiently to keep the target device's temperature within prescribed operating range. Once ignited, the shell will prevent or mitigate spraying and help focus the heat downward. To allow escape of gases, following ignition, the top face of the shell may have a plurality of small holes created by partially punching through but leaving the punched material partially attached creating an opening for gases but blocking particles from exiting through these holes.

In both preferred embodiments of a two-layer and three-layer block, the initial ignition is triggered by a low-voltage signal applied to a conductor embedded in the ignition layer of a two-layer block, or the first ignition layer of a three-layer block. It was found that a conductor having a resistance of 5 to 15 ohms, when triggered by a voltage of 3 to 5 volts, would produce sufficient heat to ignite an ignition layer in which it is embedded.

In both two-layer and three-layer blocks, the layers are mixtures of material that are bound by a bonding agent so as to produce a solid material slab. That is, the constituents were not free to move around when jostled or rotated. The bonding material is not a layer constituent, per se, that is, it does not contribute to the reaction. It is also a small proportion of the layer by weight, typically adding less than five percent.

When assembled, a two-layer block will have its ignition layer slab atop the thermite layer. The three-layer block will have a first ignition layer slab, atop a second ignition layer slab, with the second ignition layer slab atop the thermite layer.

The following details are intended to provide a more detailed description and specification of the invention.

FIG. 1 shows a three-dimensional view of the block (100), including one or two ignition layers, As shown, the target device (102) is encompassed in the thermite block (101). Dimensions A, B and C are chosen such that the block will encompass the target device and have sufficient ignition and thermite materials to produce a sufficiently high peak temperature, at least 1500 degrees C., to achieve severe damage or destruction of the target device.

Figure 7:
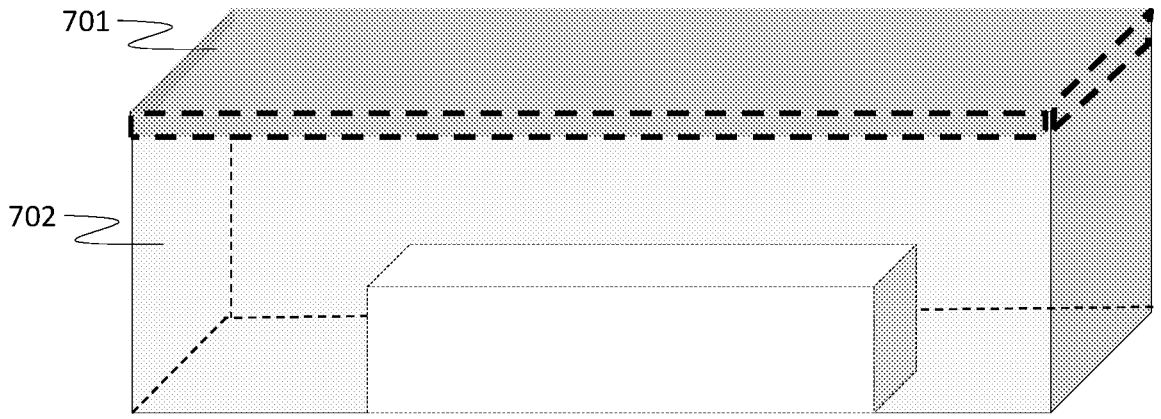
FIG. 7 depicts an exemplary two-layer embodiment of the block.

FIG. 7 shows an exemplary two-layer embodiment wherein 701 is an ignition layer, and 702 is a thermite layer. The ignition layer (701) comprises Potassium Nitrate ($KNO_3$) and powdered sugar ($C_6H_{12}O_6$) wherein constituent proportions, by percentage of ignition-layer weight, have a range of 55-70 percent and 30-45 percent, respectively. The thermite layer, 702, comprises Vanadium (V) Oxide ($V_2O_5$), Magnesium, and Barium Nitrate [$Ba(NO_3)_2$] wherein constituent proportions, by percentage of thermite layer weight, have a range of 40-55 percent, 25-35 percent and 10-30 percent, respectively. The ignition layer, by weight; and the thermite layer, by weight; have a range of 4-10 percent and 90-96 percent, respectively, of the weight of the two-layer block.

Figure 2:
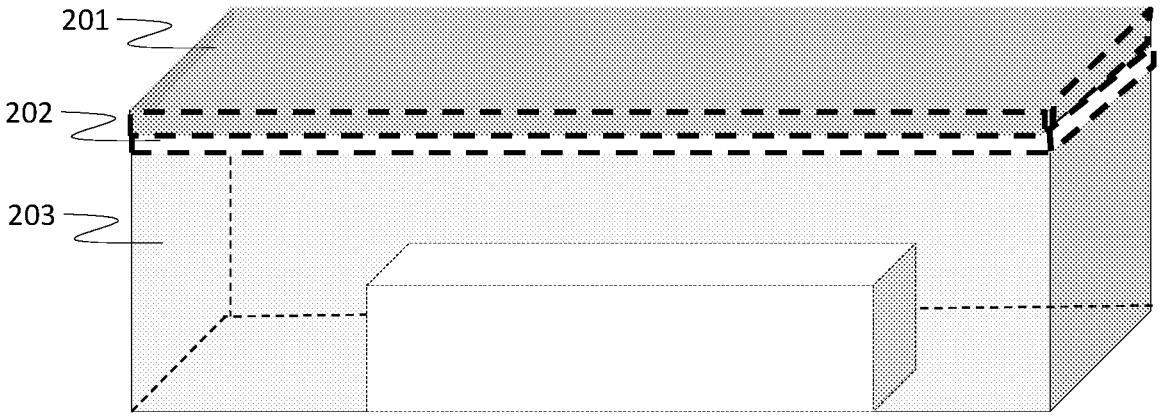
FIG. 2 depicts an exemplary three-layer embodiment of the block.

FIG. 2 shows an exemplary three-layer embodiment wherein 201 is a first ignition layer, 202 is a second ignition layer, and 203 is a thermite layer. Layer 201 comprises Potassium Nitrate ($KNO_3$) and powdered sugar ($C_6H_{12}O_6$) wherein constituent proportions, by percentage of first-ignition-layer weight, have a range of 55-70 percent and 30-45 percent, respectively. Layer 202 comprises Barium Peroxide, Aluminum powder, and Magnesium powder wherein constituent proportions, by percentage of second-ignition-layer weight, have a range of 70-80 percent, 18-26 percent and 2-12 percent, respectively. Layer 203 comprises Iron (III) Oxide ($Fe_2O_3$), Aluminum, and Barium Nitrate [$(BaNO_3)_2$] wherein constituent proportions, by percentage of thermite-layer weight, have a range of 53-66 percent, 17-24 percent and 10-30 percent, respectively. The first ignition layer, the second ignition layer, and the thermite layer, by weight, have a range of 3-5 percent, 2-4 percent, and 91-95 percent, respectively, of the weight of the three-layer block.

Figure 8:
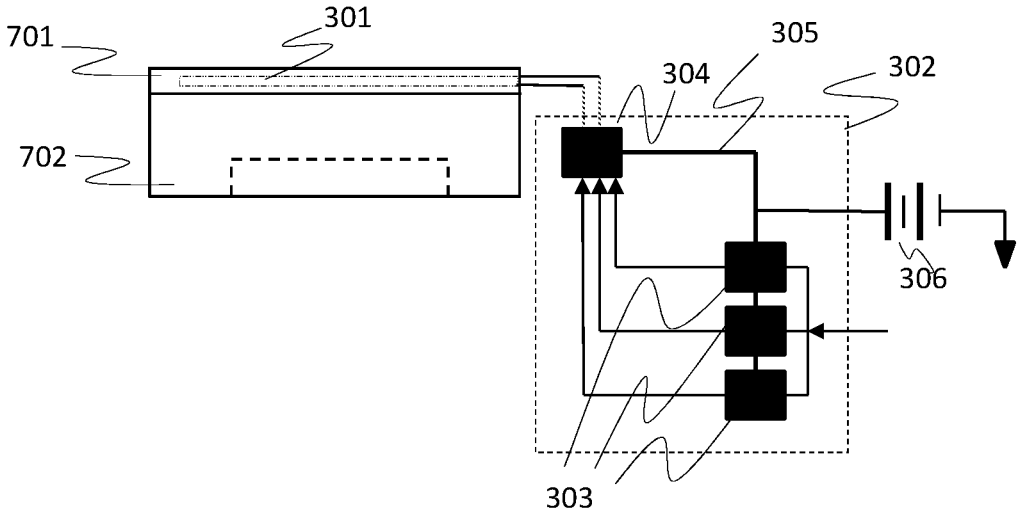
FIG. 8 depicts the block of FIG. 7 connected to an external controller.

FIG. 8 shows an exemplary embodiment of the two-layer block and an ignition triggering subsystem (302). The ignition layer (701) atop the thermite layer (702) has an embedded conductor (301) whose ends protrude from one or two edges of the ignition layer and are interfaced to an ignition triggering subsystem (302) comprising three redundant AND gates (303) interfaced to a three-input AND gate (304) operative to produce a logic 1 (3-5 volts) output when at least two of three input AND gates are at logic 1 (3-5 volts). A separate battery (306) may provide the electrical energy needed to support the triggering voltage on a power bus (305). In so doing, even if the electronic device's battery is discharged, one may convey a destruct signal and destroy the sensitive data. With the triple redundancy of 302, a single, false trigger output from any one of the three input AND gates would not trigger a destruct signal. It would take at least two of three input AND logic 1 outputs to so trigger the three-input AND gate and cause ignition. This circuit adds some protection against a single component failure resulting in a false logic 1 output on any input AND gate. The destruct signal prompting the input AND gates would be logic land could be conveyed from a manual switch, an external wireless signal, a failure to input a proper password when prompted, and the like.

Figure 3:
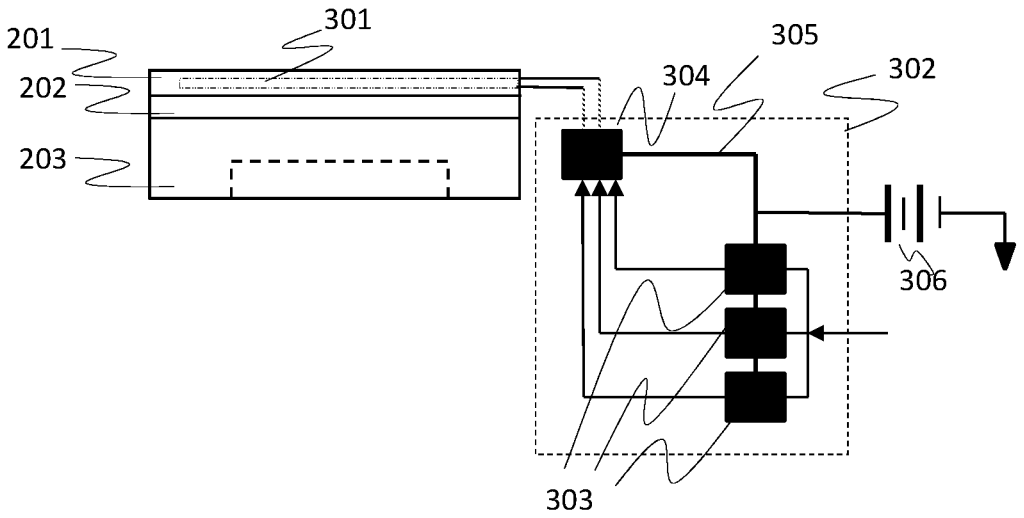
FIG. 3 depicts the block of FIG. 2 connected to an external controller.

FIG. 3 shows an exemplary embodiment of the three-layer block and an ignition triggering subsystem (302). The first ignition layer (201) has an embedded conductor (301) whose ends protrude for one or two edges of the ignition layer and are interfaced to an ignition triggering subsystem (302) comprising three redundant AND gates (303) interfaced to a three-input AND gate (304) operative to produce a logic 1 (3-5 volts) output when at least two of three input AND gates are at logic 1 (3-5 volts). A separate battery (306) may provide the electrical energy needed to support the triggering voltage on power bus (305). In so doing, even if the electronic device's battery is discharged, one may convey a destruct signal and destroy the sensitive data. Again, with the triple redundancy of 302, a single, false trigger output from any one of the three input AND gates would not trigger a destruct signal. It would take at least two of three input AND logic 1 outputs to so trigger the three-input AND gate and cause ignition. This circuit adds some protection against a single component failure resulting in a false logic 1 output on any input AND gate. The destruct signal prompting the input AND gates would be logic land could be conveyed from a manual switch, an external wireless signal, a failure to input a proper password when prompted, and the like.

Figure 4:
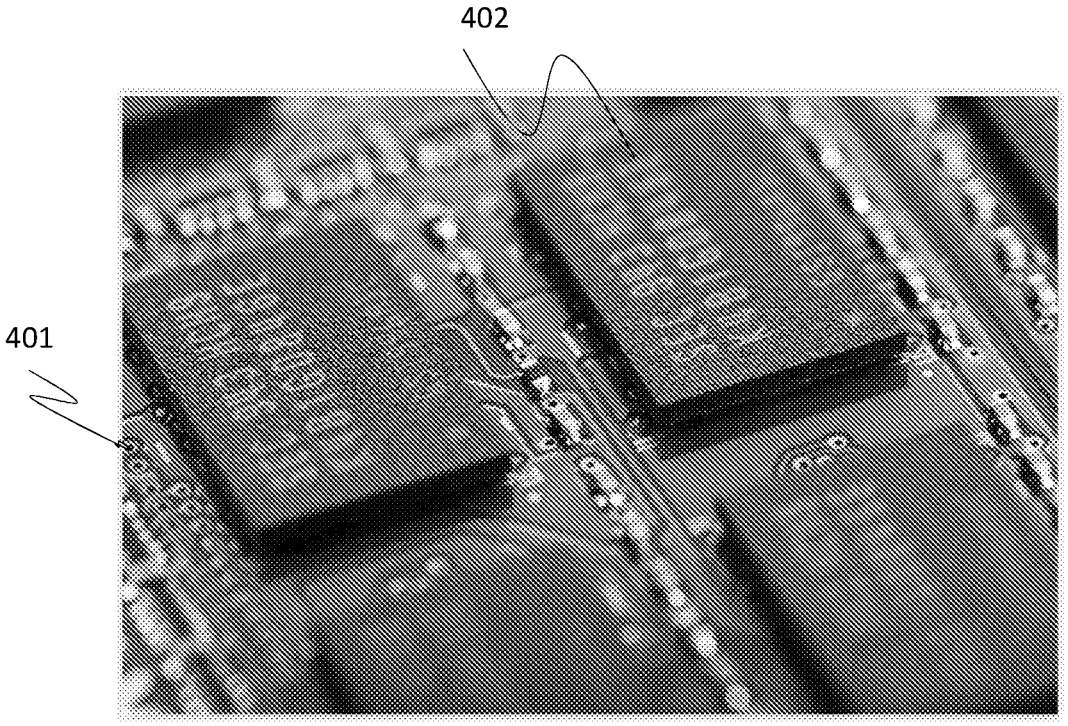
FIG. 4 shows an exemplary view of a portion of a PC board and a pair of non-volatile data storage devices.

FIG. 4 shows a portion of a printed-circuit board (PCB), 401, and a non-volatile memory device (402). The device, 402, could be selected as a target device. As shown, it extends above the PCB and covers an area equivalent to its package's length and width dimensions. An embodiment of the invention meant to secure data on this device would have dimension that extend beyond those of the target device's length and width, and a height greater than the target device's height above the PCB. A carve out in the lower face of the invention embodiment would enable the embodiment to encompass the target device and the embodiment's lower periphery would extend to contact the PCB surface.

Figure 5:
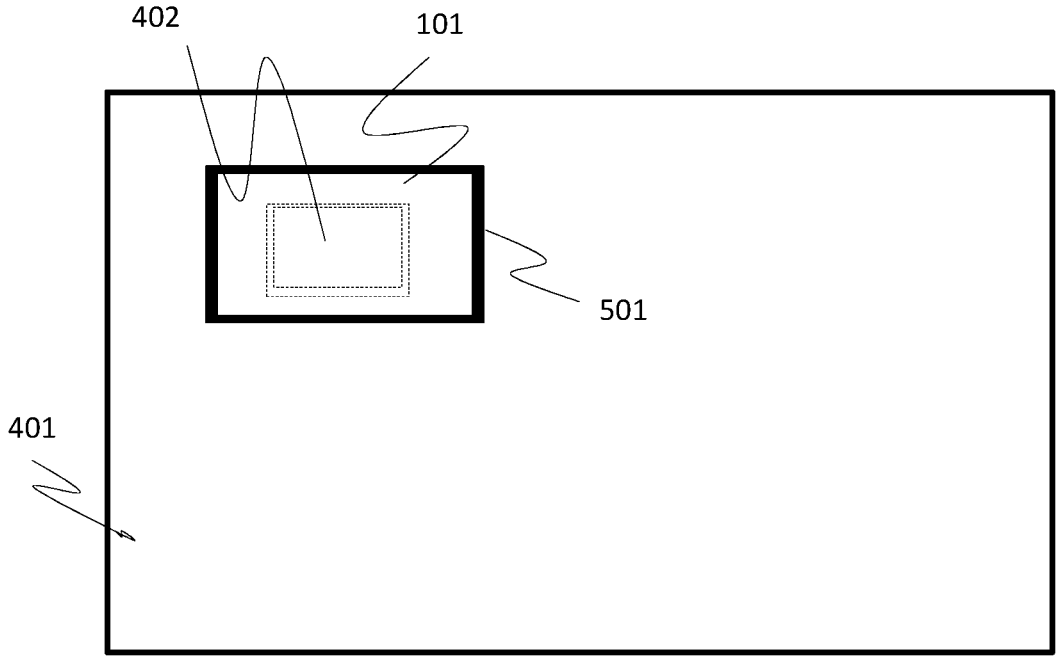
FIG. 5 depicts a top-down view of the block encompassing a target device.

FIG. 5 shows a top-down view of how the embodiment (101) alluded to in FIG. 4 would be located relative to the target device, 402, on the PCB (401). An adhesive waterproofing agent (501) would be applied to the bottom periphery of the embodiment (101) so as to affix it to the PCB and prevent water intrusion. Two small clamping devices (not shown), on two opposing sides of the shell, and to the surface below 402, may serve to keep the interface intact during ignition despite internal gaseous pressure.

Figure 6:
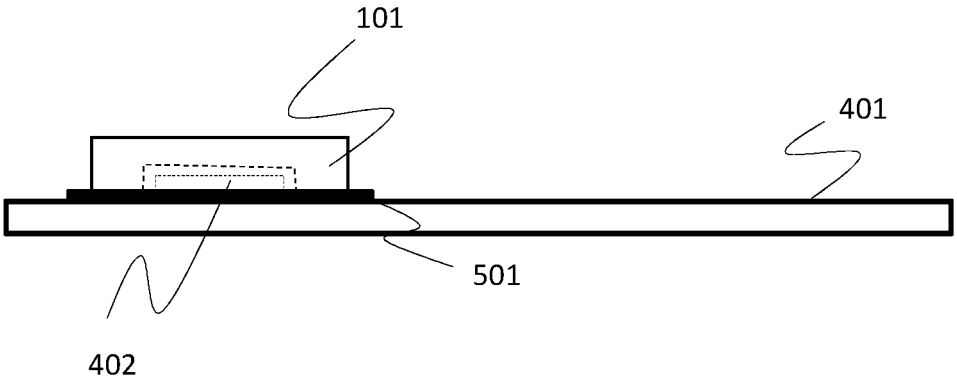
FIG. 6 depicts a side view of the block, encompassing a target device, and mounted to the PC board as well as sealed against fluids by an appropriate adhesive sealant.

FIG. 6 is a side view of the embodiment (101) encompassing the target device (402), sealed in place by the adhesive waterproofing agent (501) on the PCB (401).

As noted, the embodiment of the block (101) shown in the various figures could be either the two-layer or three-layer block structure. As noted, the shell that surrounds block 101 may comprise metal, ceramic, carbon fiber, or graphite. A rectangular, three-dimensional embodiment has been illustrated wherein the target device is rectangular and three-dimensional. A target device that is square and three-dimensional, such as a mini disk drive would require a block whose dimensions follow those of the target device. Thus, a rectangular three-dimensional embodiment is exemplary rather than limiting the shape of the invention.

What is claimed is:

1. A multi-layer thermite block comprising:

at least one ignition layer;

mixtures of constituent materials of the at least one ignition layer are bonded to form a solid slab of constituent ignition material;

a thermite layer;

mixtures of constituent materials in the thermite layer are bonded to form a solid slab of constituent thermite material;

layers interface via physical contact of slab faces;

interfacing layers are bonded to one another;

the multi-layer thermite block comprises a rectangular three-dimensional structure;

the rectangular three-dimensional structure is encased in an exterior protective shell;

wherein the exterior protective shell covers a top and all side faces of the multi-layer thermite block;

wherein the bottom face of the multi-layer thermite block, which is one face of the thermite layer, is exposed; and a conducting wire is embedded in the at least one ignition layer with each end protruding from at least one edge of the at least one ignition layer.

2. A claim as in claim 1 wherein:

the multi-layer thermite block comprises a single ignition layer and a two-layer-based thermite layer;

the single ignition layer comprises Potassium Nitrate ($KNO_3$) and powdered sugar ($C_6H_{12}O_6$) wherein constituent proportions, by percentage of single-ignition-layer weight, have a range of 55-70 percent and 30-45 percent, respectively;

the two-layer-based thermite layer comprises Vanadium (V) Oxide ($V_2O_5$), Magnesium, and Barium Nitrate [$Ba(NO_3)_2$] wherein constituent proportions, by percentage of thermite layer weight, have a range of 40-55 percent, 25-35 percent and 10-30 percent, respectively;

the proportions, by weight, of the single ignition layer and single thermite layer to the multi-layer thermite block have a range of 4-10 percent and 90-96 percent; and the conducting wire is embedded in the single ignition layer.

3. A claim as in claim 1 wherein:

the multiple-layer thermite block comprises a first ignition layer, a second ignition layer, and a three-layer-based thermite layer:

the first ignition layer comprises Potassium Nitrate ($KNO_3$) and powdered sugar ($C_6H_{12}O_6$) wherein constituent proportions, by percentage of first-ignition-layer weight, have a range of 55-70 percent and 30-45 percent, respectively;

the second ignition layer comprises Barium Peroxide, Aluminum powder, and Magnesium powder wherein constituent proportions, by percentage of second-ignition-layer weight, have a range of 70-80 percent, 18-26 percent, and 2-12 percent, respectively;

the three-layer-based thermite layer comprises Iron (III) Oxide ($Fe_2O_3$), Aluminum, and Barium Nitrate [$(BaNO_3)_2$] wherein constituent proportions, by percentage of thermite layer weight, have a range of 53 to 66 percent, 17-24 percent and 10-30 percent, respectively;

the proportions, by weight, of the first ignition layer, the second ignition layer, and the single thermite layer to the weight of the multi-layer thermite block have the range 3-5 percent, 2-4 percent and 91-95 percent, respectively; and the conducting wire is embedded in the first ignition layer.

4. A claim as in claim 1 wherein:

the conducting wire has a resistance range of 5-15 ohms.

5. A claim as in claim 1 wherein:

the exterior protective shell's material comprises metal.

6. A claim as in claim 1 wherein:

the exterior protective shell's material comprises ceramic.

7. A claim as in claim 1 wherein:

the exterior protective shell's material comprises carbon fiber.

8. A claims as in claim 1 wherein:

the exterior protective shell's material comprises graphite.

9. A claim as in claim 1 further comprising:

the bottom face the multi-layer thermite block has a carve out operative to enable the multi-layer thermite block to encompass a target device such that the bottom face's periphery can make contact with a surface below the target device.

10. A claim as in claim 1 further comprising:

an ignition controller subsystem.

11. A claim as in claim 10 wherein:

the ignition controller subsystem operative to produce an output voltage sufficient to cause ignition when a destruct signal of logic 1 has been conveyed to the ignition controller's input.

12. A claim as in claim 11 further comprising:

three redundant input gates conveying outputs to a three-input gate such that the output voltage sufficient to cause ignition will only be generated when two out of three inputs are logic 1 thereby enabling a triple-redundancy protection against single input-gate failure.

13. A method of use comprising:

carving out a space from a bottom face of a multi-layer thermite block sufficient to encompass a target device;

applying a waterproofing adhesive to the bottom face's periphery operative to adhere to a surface below the target device so as to affix the block to the surface and provide protection against water intrusion;

placing the multi-layer thermite block atop the target device such that the target device is encompassed and the bottom face's periphery is in contact with the surface below the target device; and allowing the waterproofing adhesive to cure.

14. A method as in claim 13 further comprising:

attaching both ends of an embedded conductor protruding from at least one edge of an ignition layer to both output nodes of an ignition controller subsystem.

* * * * *